US007980252B2

(12) United States Patent
Yue

(10) Patent No.: US 7,980,252 B2
(45) Date of Patent: Jul. 19, 2011

(54) NAIL DRYING AND DECORATING ASSEMBLY

(75) Inventor: Brenda P. K. Yue, Kowloon (HK)

(73) Assignee: Conair Corporation, Stamford, CT (US)

( * ) Notice: Subject to any disclaimer, the term of this patent is extended or adjusted under 35 U.S.C. 154(b) by 438 days.

(21) Appl. No.: 12/355,959

(22) Filed: Jan. 19, 2009

(65) Prior Publication Data

US 2009/0183746 A1 Jul. 23, 2009

Related U.S. Application Data

(60) Provisional application No. 61/022,118, filed on Jan. 18, 2008.

(51) Int. Cl.
*A45D 29/18* (2006.01)

(52) U.S. Cl. ..... 132/73.5

(58) Field of Classification Search ..... 132/73.5, 132/73, 73.6, 75.8, 76.5; 34/202, 96, 97, 34/98

See application file for complete search history.

(56) References Cited

U.S. PATENT DOCUMENTS

| | | | | |
|---|---|---|---|---|
| 2,673,402 | A * | 3/1954 | Chambers | 34/202 |
| 5,084,984 | A * | 2/1992 | Duchoud et al. | 34/549 |
| 5,280,679 | A * | 1/1994 | Edelman | 34/66 |
| 6,035,857 | A * | 3/2000 | Hartelius et al. | 132/73 |
| 6,065,478 | A * | 5/2000 | Hartelius et al. | 132/73 |
| 6,658,759 | B2 * | 12/2003 | Hu | 34/202 |
| 2006/0260628 | A1 * | 11/2006 | Chan | 132/73 |

* cited by examiner

*Primary Examiner* — Robyn Doan
(74) *Attorney, Agent, or Firm* — Lawrence Cruz

(57) ABSTRACT

An appliance 1 according to the present invention comprises a bottom tray 2, a middle housing 3, a transparent lid 4, a lid release button 5 for removing the lid from the housing 3, at least one finger hole 6 for receiving a user's finger, and a glittering switch 7 for activating an automatic glitter application sequence. A glittering tray 9 is housed inside of the middle housing 3 and has a plurality of separate chambers or can have a single chamber. A finger hole 10 corresponding to each chamber is provided and the tray 9 can be manipulated to line up the hole 10 with the finger hole 6. Glitter fragments are loaded into the one or more chambers 32 and, as described below, will be blown about and dispersed so that some settle on and adhere to freshly painted nails before they dry.

4 Claims, 5 Drawing Sheets

NAIL DRYING AND DECORATING ASSEMBLY

CROSS-REFERENCE TO RELATED APPLICATIONS

None.

BACKGROUND OF THE INVENTION

1. Field of the Invention

The present invention relates to personal beauty appliances and, more particularly, to nail drying and decorating appliances for drying or decorating fingernails and toenails.

2. Description of Related Art

Various known appliances exist for drying nails including tabletop units with heaters and fans to circulate air over freshly polished nails. Certain nail polishes include glitter fragments mixed in a liquid for creating glitter-speckled finished nails.

No known device exists for achieving both drying and glitter application in a single unit. No known device exists for achieving glitter application in an automatic device.

OBJECTS OF THE PRESENT INVENTION

It is an object of the present invention to provide an appliance for both drying and glitter application in a single unit. It is another object of the invention to provide nail glitter application in an automatic device.

These and other objects are achieved by the present invention.

DETAILED DESCRIPTION OF THE PREFERRED EMBODIMENTS OF THE INVENTION

Figure 1C:
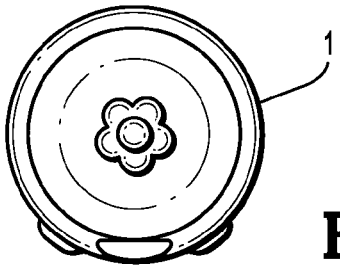
FIG. 1C is a top view of an appliance according to the present invention.
Figure 1A:
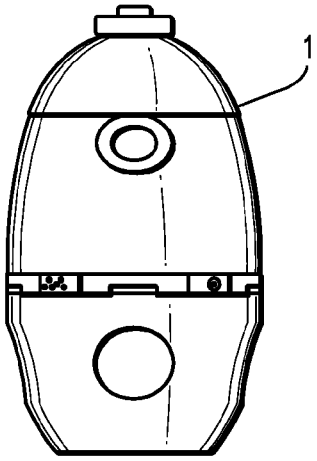
FIG. 1A is a front view of an appliance according to the present invention.
Figure 1B:
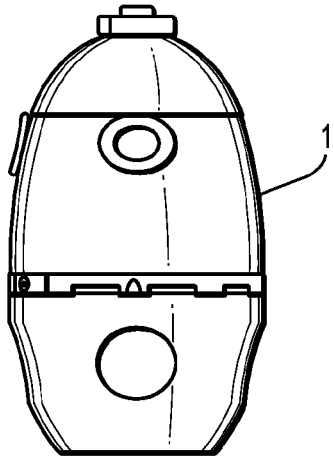
FIG. 1B is a side view of an appliance according to the present invention.
Figure 2:
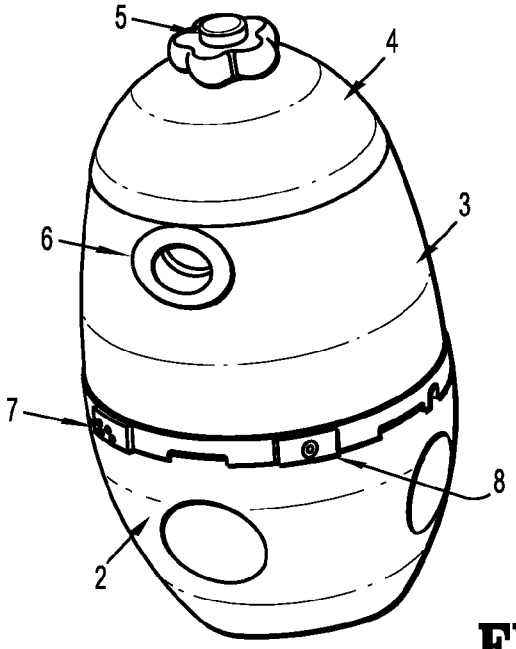
FIG. 2 is a perspective view of an appliance according to the present invention.
Figure 3:
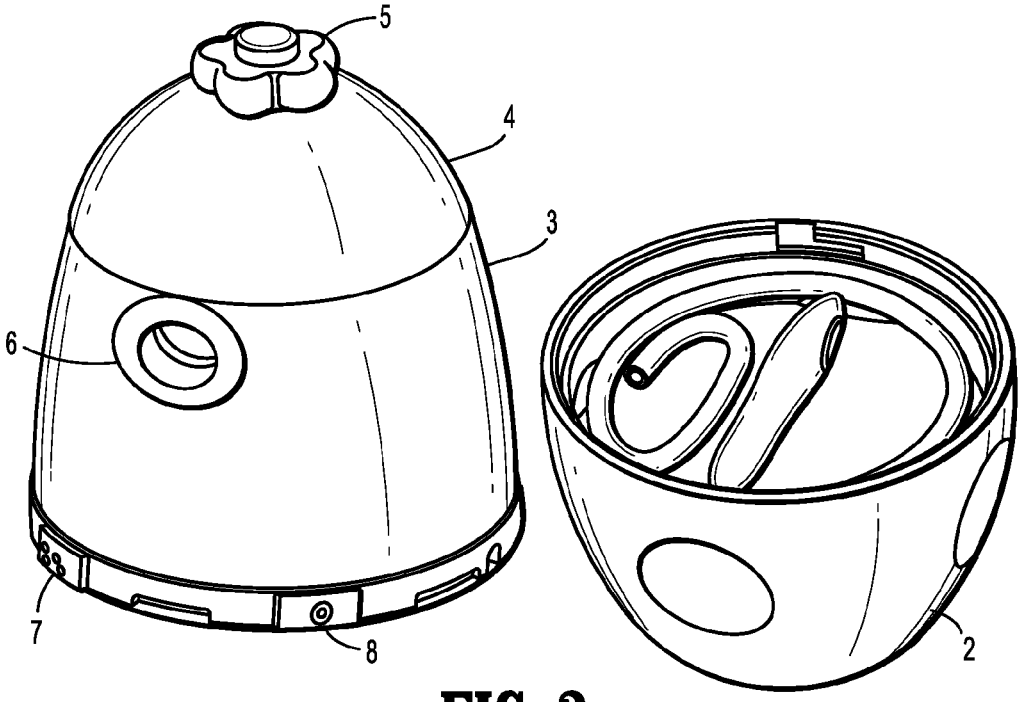
FIG. 3 is an unassembled, perspective view of an appliance according to the present invention.
Figure 4A:
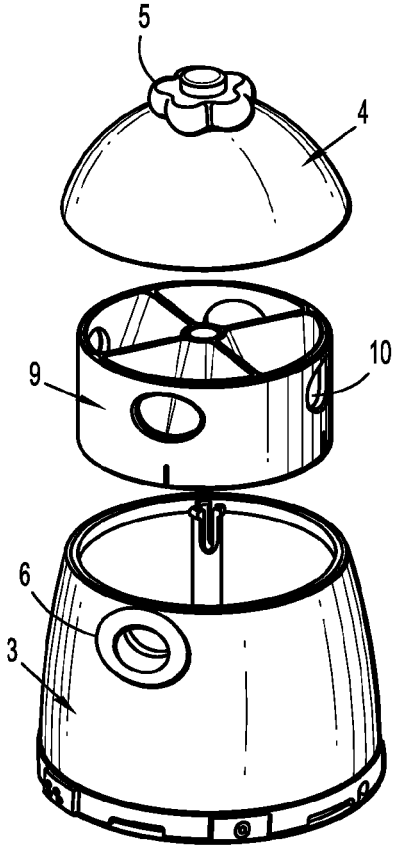
FIG. 4A is an exploded, perspective view of an appliance according to the present invention.
Figure 4B:
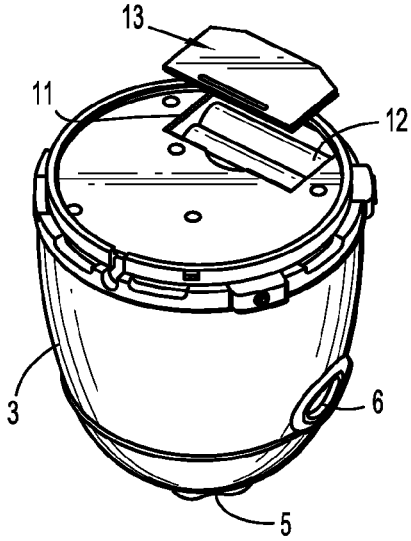
FIG. 4B is a partial, bottom, perspective view of an appliance according to the present invention.
Figure 5:
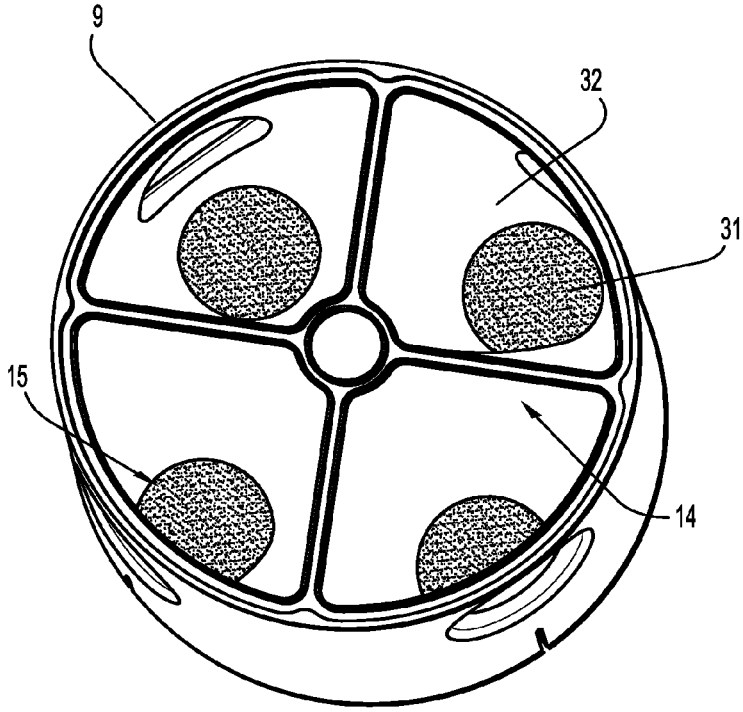
FIG. 5 is a perspective view of a component of an appliance according to the present invention.
Figure 6:
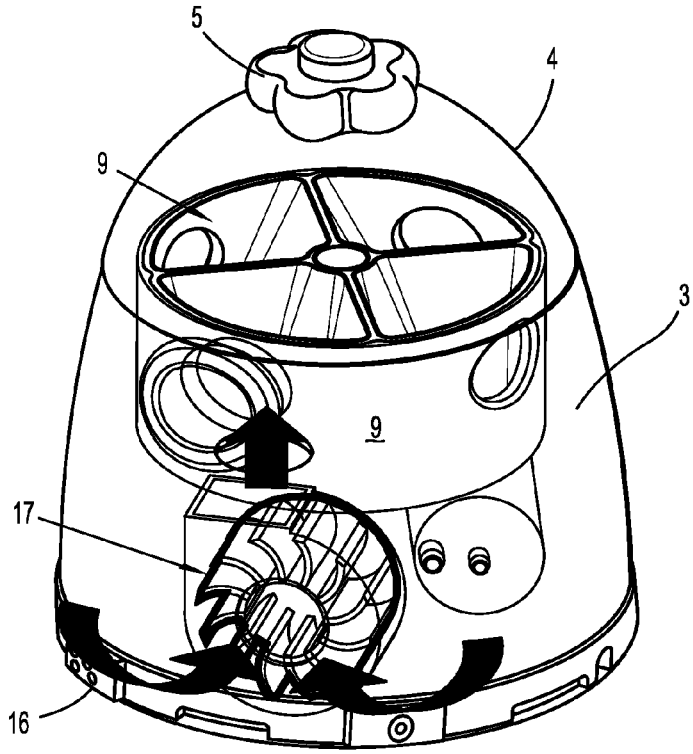
FIG. 6 is a partial, perspective, transparent, schematic view of an appliance according to the present invention.
Figure 7:
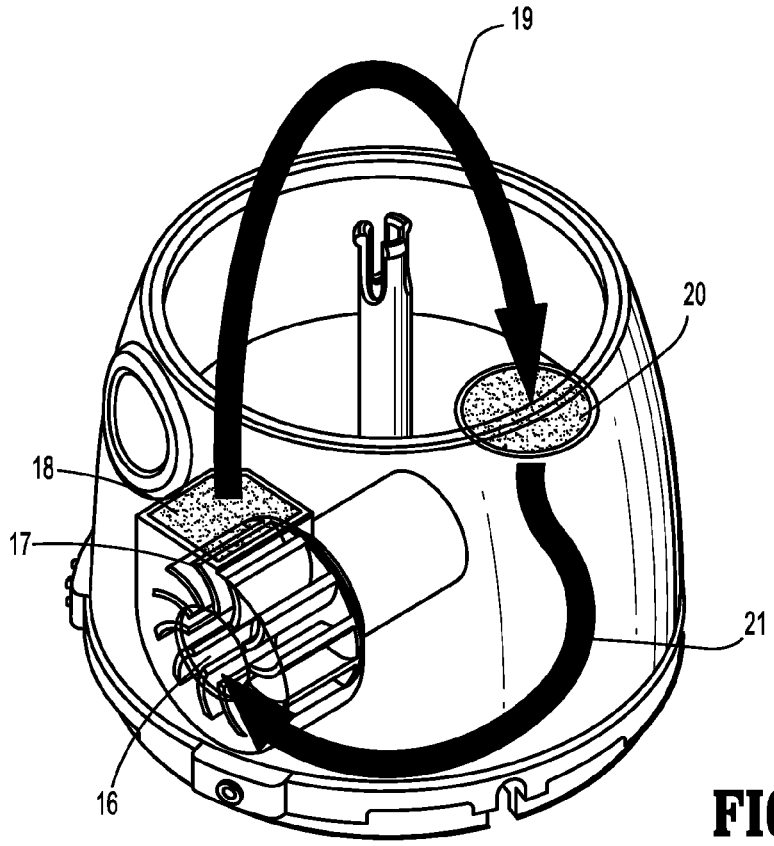
FIG. 7 is a partial, perspective, transparent, schematic view of an appliance according to the present invention.
Figure 8:
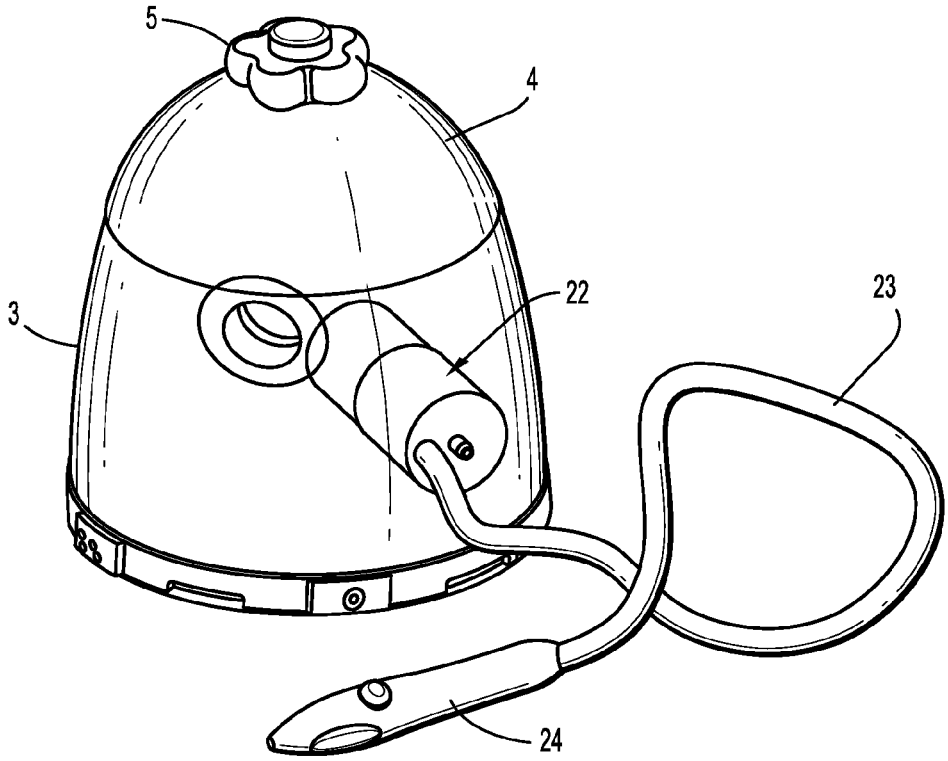
FIG. 8 is a perspective view of an appliance according to the present invention showing an accessory attached thereto.
Figure 9:
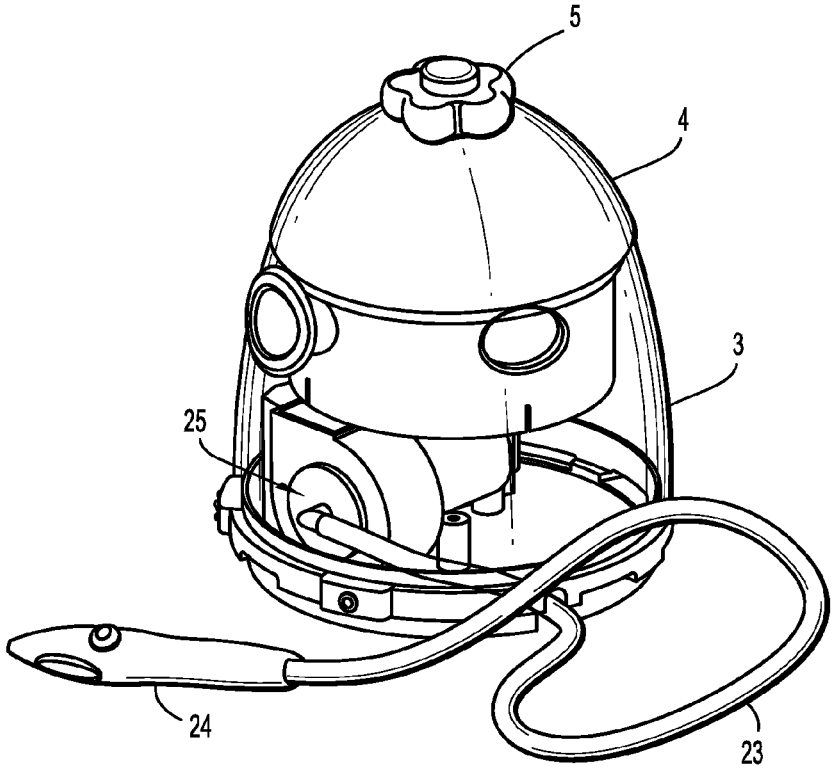
FIG. 9 is a perspective view of an appliance according to an alternative embodiment of the present invention showing an accessory attached thereto.
Figure 10:
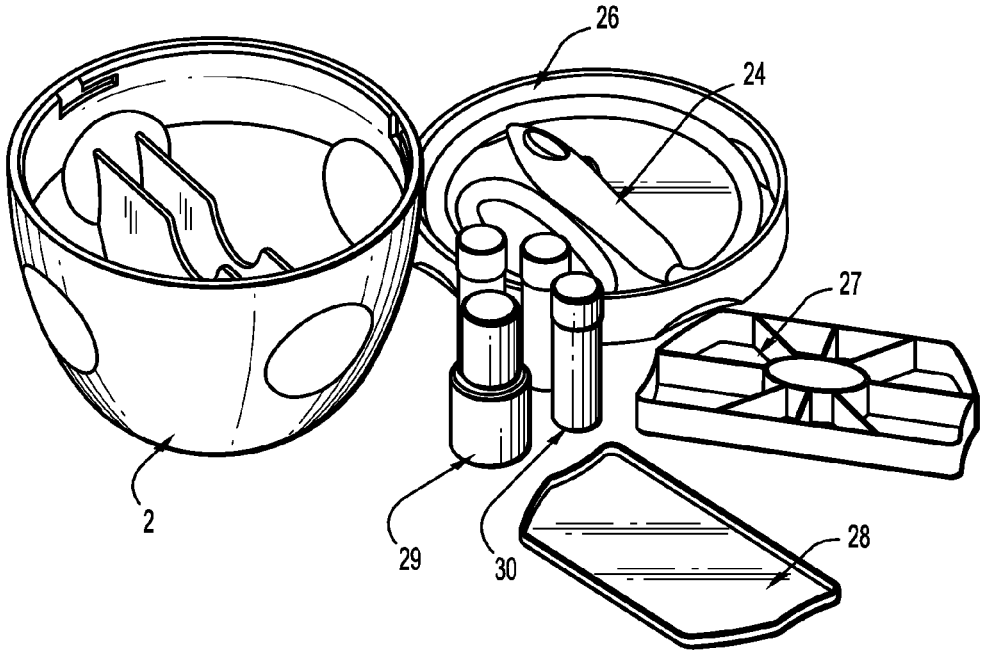
FIG. 10 is an unassembled, perspective view of an appliance according to an alternative embodiment of the present.

Referring to FIGS. 1-10, an appliance 1 according to the present invention comprises a bottom tray 2, a middle housing

3, a transparent lid 4, a lid release button 5 for removing the lid from the housing 3, at least one finger hole 6 for receiving a user's finger, a glittering switch 7 for activating an automatic glitter application sequence, and a "magic pen" switch 8 for releasing a multiple function pen-shaped implement 24. A glittering tray 9 is housed inside of the middle housing 3 and has a plurality of separate chambers or can have a single chamber. A finger hole 10 corresponding to each chamber is provided and the tray 9 can be manipulated to line up the hole 10 with the finger hole 6. Glitter fragments are loaded into the one or more chambers 32 and, as described below, will be blown about and dispersed so that some settle on and adhere to freshly painted nails before they dry. The underside of the middle housing 3 has a battery compartment 11 for holding batteries 12, and a battery cover 13. Each chamber 32 has a filter 31 through which air flows to disperse the glitter fragments. An air intake 16 is located on the side of the middle housing 3. An air pump 17 is associated with the intake 16 and driven by a conventional electric motor (not shown) to draw external air into the appliance 1. The air is directed up through the tray 9 to disperse the glitter fragments.

Optionally, the appliance 1 can be used simply for drying freshly painted nails without the application of glitter simply by not loading glitter fragments into the tray 9 or by removing the tray 9. A filter 18 may be provided on the fan assembly. Air is directed along the path 19 shown in FIG. 7, and routed out via the path 21 to return to the air pump 17.

Suction is created by the airflow to allow a vacuuming function via a hose 23 and the pen-like wand 24 for cleaning up glitter fragments. Alternatively, the hose 23 and wand 24 may be attached to the blower intake by a blower attachment 25, so that the wand can be used for vacuuming. An inner tray 26 may be removably housed in the appliance 1 and used for storing the hose 23 and wand 24. A jewelry box 27 with cover may be provided to hold various items including nail polish 29 and glitter fragments 30.

While the preferred embodiments have been shown and described, various modifications can be made without departing from the scope of the present invention.

What is claimed is:

1. A nail drying and decorating appliance for drying or decorating fingernails, said appliance comprising a lower housing having a floor and a generally cylindrical wall section;

an upper housing adapted to be removably mounted to said lower housing, said upper housing having a generally cylindrical wall section so that an opening is formed at the top of said upper housing;

a lid adapted to be removably mounted to said upper housing to cover said opening;

an electrically powered fan;

an air inlet in said lower housing adapted to draw air into said housing when said fan is operated;

an external finger opening in said upper housing adapted to permit a user to insert a finger into said external finger opening so that the fingernail on said finger may be dried or decorated by air moved by said fan;

a generally cylindrical glittering tray removably mounted in said upper housing above said air inlet, said glittering tray having at least one chamber including a floor and holding a plurality of decorative glitter fragments to be applied to wet or freshly polished fingernails;

a filter associated with said at least one chamber, said filter comprising an air-permeable opening in said floor of said at least one chamber, and said floor is located between said air inlet and air outlet so that air caused to move by said fan passes through said filter; and a filter finger opening in said glittering tray adapted to be aligned with said external finger opening so that a user's finger extending through said external finger opening also extends through said filter finger opening such that during operation of said fan said glittering fragments are caused to be carried by moving air and at least some of said glittering fragments contact a user's fingernail while it extends through said filter finger opening.

2. An appliance according to claim 1, wherein said glittering tray comprises a plurality of chambers and a plurality of corresponding filter finger openings and a plurality of corresponding filters, one of each being respectively associated with one of said chambers; and said glittering tray is selectively positionable such that any one of said filter finger openings may be selectively aligned with said external finger opening.

3. An appliance according to claim 1, further comprising a vacuum attachment adapted to be attached to said air inlet to cause suction pressure to draw debris through said vacuum attachments while said fan is operating.

4. A nail drying and decorating appliance for drying or decorating fingernails, said appliance comprising a housing having a floor and a generally cylindrical wall section;

an electrically powered fan;

an air inlet in said housing adapted to draw air into said housing when said fan is operated;

an external finger opening in said housing adapted to permit a user to insert a finger into said external finger opening so that the fingernail on said finger may be dried or decorated by air moved by said fan;

a glittering tray removably mounted in said housing above said air inlet, said glittering tray having at least one chamber including a floor and holding a plurality of decorative glitter fragments to be applied to wet or freshly polished fingernails;

a filter associated with said at least one chamber, said filter comprising an air-permeable opening in said floor of said at least one chamber, and said floor is located between said air inlet and air outlet so that air caused to move by said fan passes through said filter; and a filter finger opening in said glittering tray adapted to be aligned with said external finger opening so that a user's finger extending through said external finger opening also extends through said filter finger opening such that during operation of said fan said glittering fragments are caused to be carried by moving air and at least some of said glittering fragments contact a user's fingernail while it extends through said filter finger opening.

* * * * *